US006174179B1

(12) United States Patent
Okabe

(10) Patent No.: US 6,174,179 B1
(45) Date of Patent: Jan. 16, 2001

(54) LEVER ENGAGEMENT CONNECTOR HAVING ENGAGING AND DISENGAGING FULCRUMS

(75) Inventor: Toshiaki Okabe, Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/292,857

(22) Filed: Apr. 16, 1999

(30) Foreign Application Priority Data

Apr. 17, 1998 (JP) ..... 10-108074

(51) Int. Cl.[7] ..... H01R 13/62
(52) U.S. Cl. ..... 439/157
(58) Field of Search ..... 439/157, 372, 439/160, 342

(56) References Cited

U.S. PATENT DOCUMENTS 3,801,757 * 4/1974 Carissimi ..... 439/157
5,362,245 * 11/1994 Suguro ..... 439/160
5,711,682 * 1/1998 Maejima ..... 439/157

FOREIGN PATENT DOCUMENTS 6-124747 5/1994 (JP) ..... H01R/13/629
6-140098 5/1994 (JP) ..... H01R/13/631
6-302353 10/1994 (JP) ..... H01R/13/629

* cited by examiner

*Primary Examiner*—Neil Abrams
*Assistant Examiner*—Javaid Nasri
(74) *Attorney, Agent, or Firm*—Sughrue, Mion, Zinn Macpeak & Seas, PLLC

(57) ABSTRACT

A lever engagement type connector in which the connector (male connector) is engaged with a female connector by rotating a lever attached to the male connector. An engagement fulcrum, which becomes a fulcrum in the case of engagement of the male connector with the female connector, and a disengagement fulcrum, which becomes a fulcrum in the case of disengagement of the male connector from the female connector, are arranged in an engaging hole of the female connector being separated from each other, and a space formed between the engagement fulcrum and the disengagement fulcrum becomes an idle running space. When the lever is rotated, a protrusion of the lever is moved in the idle running space under the condition of disengagement. Therefore, the male connector can be simply disengaged from the female connector by a low intensity of force.

4 Claims, 2 Drawing Sheets

LEVER ENGAGEMENT CONNECTOR HAVING ENGAGING AND DISENGAGING FULCRUMS

BACKGROUND OF THE INVENTION

1. Field of the Invention

The present invention relates to a lever engagement type connector in which the connector is engaged with a mating connector by rotating a lever attached to the connector.

2. Description of the Related Art

FIG. 3 is a view showing a conventional lever engagement type connector. As shown in FIG. 3, this lever engagement type connector includes: a male connector 1; a lever 2 pivotally attached to the male connector 1; and a female connector 3 with which the male connector 1 is engaged.

The male connector 1 is provided with a plurality of terminal receiving chambers (not shown) in which terminals are received. The respective terminal receiving chambers are communicated with terminal insertion holes formed on the bottom wall. When the male connector 1 is inserted into the female connector 3, mating terminals (not shown) of the female connector 3 are inserted into the terminal insertion holes. Due to the foregoing, the terminals in the terminal receiving chambers of the male connector 1 are contacted and communicated with the mating terminals of the female connector 3.

At substantial centers of both side walls 6 of the male connector 1, there are provided bosses 7 which protrude from the side walls 6. When the lever 2 is supported by these bosses 7, the lever 2 can be rotated about the bosses 7.

The lever 2 includes: a pair of lever walls 12 which are arranged in the transverse direction; and an operating portion 13 for connecting the lever walls 12. In each lever wall 12 of the lever 2, there is formed a rotary hole 14 into which the boss 7 of the male connector 1 is inserted. When the bosses 7 of the male connector 1 are inserted into the rotary holes 14 in the lever walls 12, the lever 2 is rotated about the bosses 7 along both side walls 6 of the male connector 1.

At one end of each lever wall 12, there is provided a protrusion 15. On the other hand, the operating portion 13 is arranged at the other end of the lever wall 12 which is located on the opposite side to the end of the lever at which the protrusion 15 is formed. The protrusion 15 is engaged with an engaging hole 16 of the female connector 3. When the operating portion 13 is pressed under the above condition, the lever 2 is rotated and the male connector 1 is engaged with the female connector 3. In this case, the operating portion 13 functions as a point of force, the engaging point of the protrusion 15 with the engaging hole 16 functions as a fulcrum, and the boss 7 functions as a point of application.

There is provided a lock arm 18 at the end on the side of the operating portion 13 of the lever 2. The lock arm 18 is provided with a lock protrusion 19 and arranged in the lever 2 in an elastic condition. When the lock protrusion 19 is engaged with the female connector 3, the male connector 1 is prevented from being disengaged from the female connector 3 via the lever 2.

The female connector 3 is provided with a hood 17 with which the male connector 1 is engaged. The above engaging hole 16 is formed in a side wall 17*a* on one side of the hood 17. In a side wall 17*b* opposed to this side wall 17*a* in which the engaging hole 16 is formed, there is formed a lock hole 21 in which the lock arm 18 is engaged. In this connection, the mating terminals (not shown) are protruded from the bottom of the hood 17.

In this lever engagement type connector, the lever 2 is incorporated into the male connector 1, and the male connector 1 is inserted into the hood 17 of the female connector 3. After that, when the operating portion 13 of the lever 2 is pressed, the lever 2 is rotated. In the process of rotation, the protrusion 15 is engaged with the engaging hole 16 of the hood 17. Therefore, the protrusion 15 becomes a fulcrum of rotation. Therefore, the lever 2 and the male connector 1 are integrated into one body and engaged with the hood 17. Due to the above engagement, the lock protrusion 19 of the lock arm 18 is engaged with the lock hole 21 of the hood 17. Accordingly, the male connector 1 is stably held by the hood 17 of the female connector 3 under the condition that the male connector 1 is prevented from being disengaged from the hood 17.

When the male connector 1 is picked up from the hood 17 of the female connector 3, the lock arm 18 is bent by an operator's finger or the like, and the lever 2 is pulled up while the lock protrusion 19 is being disengaged from the lock hole 21. When the lever 2 is pulled up in this way, the male connector 1 is simultaneously pulled up. Therefore, it is possible to pick up the male connector 1 from the hood 17 of the female connector 3 together with the lever 2.

However, the following problems may be encountered in the above conventional lever engagement type connector. When the male connector 1 is disengaged from the female connector 3, since the protrusion 15 is engaged with the engaging hole 16, it is necessary to simultaneously rotate and pull up the lever 2 and the male connector 1 about the engagement position of the protrusion 15 with the engaging hole 16 under the condition that the lock arm 18 is pressed by the operator's finger. For the above reasons, it is necessary to press the lock arm 18 simultaneously when the lever 2 and the male connector 1 are rotated round the engaging hole 16. Therefore, the operator's finger is given a heavy load when the male connector is detached from the female connector. Accordingly, the operator feels a pain in the work of disengaging the connector.

SUMMARY OF THE INVENTION

It is an object of the present invention to provide a lever engagement type connector in which the operator's finger is not given a heavy load when the connector is connected or disconnected so that the operator feels no pain in the work of connecting or disconnecting.

In order to accomplish the above object, the invention provides a lever engagement type connector in which the connector is engaged with a mating connector by rotating a lever attached to the connector, wherein the mating connector includes an engagement fulcrum which is used as a fulcrum when the connector and the mating connector are engaged with each other, and also includes a disengagement fulcrum which is used as a fulcrum when the connector and the mating connector are disengaged from each other, the engagement fulcrum and the disengagement fulcrum being separated from each other, wherein the lever includes a protrusion which moves between the engagement fulcrum and the disengagement fulcrum and engages with the respective fulcrums, the protrusion being arranged on one side of the lever, wherein the lever also includes a lock arm which is engaged with the mating connector so that the engagement condition of the connector is held, the lock arm being arranged on the other side of the lever, and wherein an idle running space, in which the protrusion moves under the condition of disengagement when the lock arm is disengaged from the mating connector, is formed between the engagement fulcrum and the disengagement fulcrum.

In the present invention, when the connector is engaged with the mating connector, the protrusion of the lever is engaged with the engagement fulcrum, and when the connector is disengaged from the mating connector, the protrusion of the lever is engaged with the disengagement fulcrum. The engagement fulcrum and the disengagement fulcrum are separate from each other, and an idle running space in which the protrusion can be moved is formed between the two fulcrums. When the lock arm is disengaged from the mating connector, the protrusion is moved in the idle running space from the engagement fulcrum to the disengagement fulcrum. At this time, the protrusion is moved in the idle running space under the condition it is not engaged. At the point of time when the lock arm is disengaged from the mating connector, the protrusion is engaged with the disengagement fulcrum. Accordingly, until the engagement condition of the lock arm is released, no force is given to the protrusion, that is, the protrusion is put in a free condition. Therefore, no force is required except for a force to release the lock arm. For the above reasons, it is possible to connect or disconnect the connector by a low intensity of force without giving a pain to the operator's finger.

DETAILED DESCRIPTION OF THE PREFERRED EMBODIMENT

Figure 1:
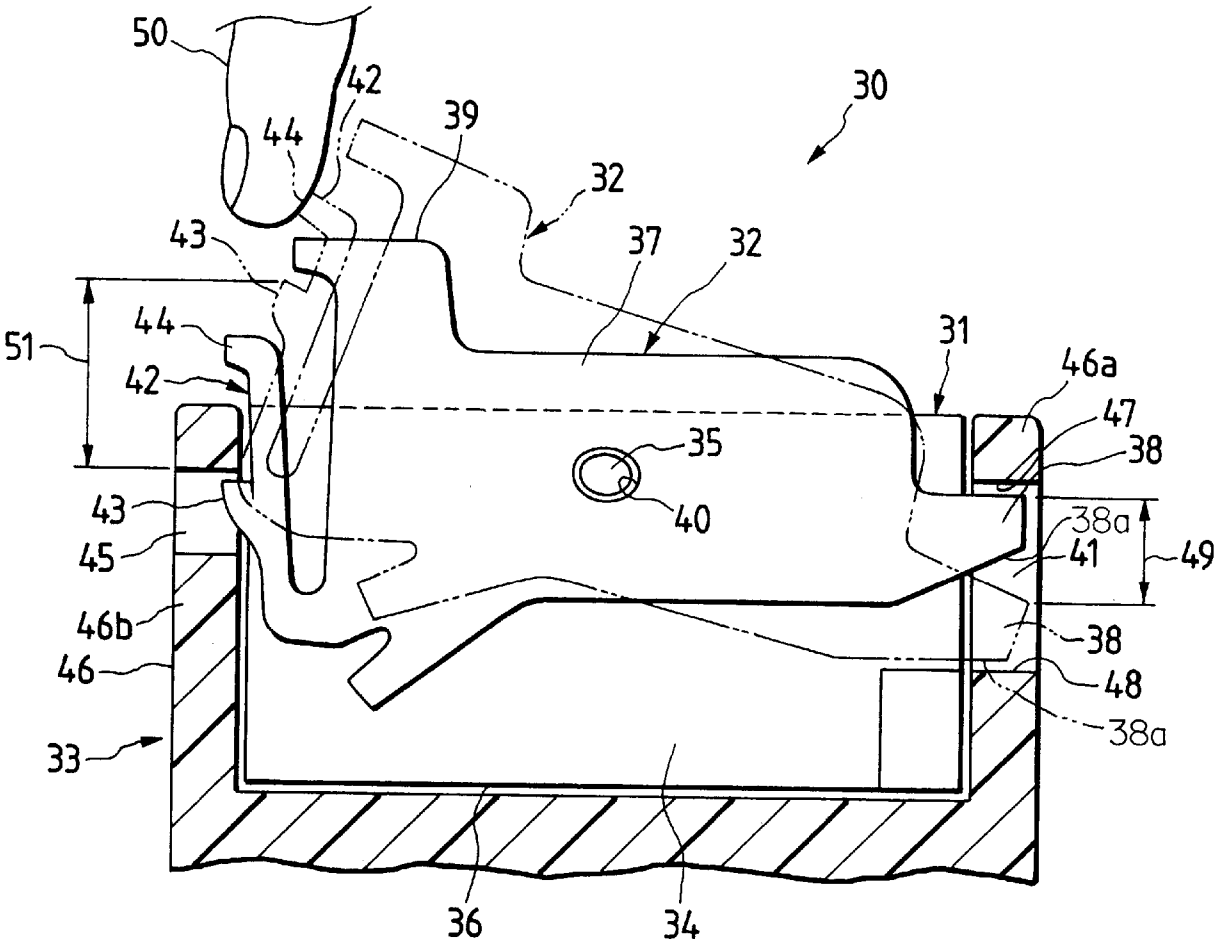
FIG. 1 is a cross-sectional view of a lever engagement type connector of an embodiment of the present invention.
Figure 2:
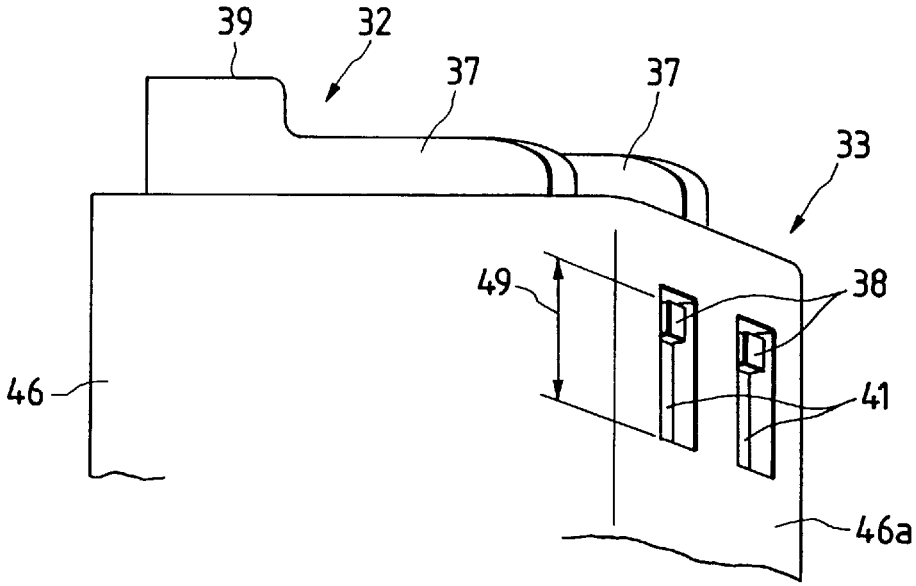
FIG. 2 is a perspective view of the connector, which is in an engagement condition, of the embodiment of the present invention.

FIGS. 1 and 2 are views showing a lever engagement type connector of an embodiment of the present invention. This lever engagement type connector 30 includes: a male connector (connector) 31; a lever 32 pivotally attached to the male connector 31; and a female connector 33 with which the male connector 31 is engaged.

At the substantial centers of both side walls 34 of the male connector 31, there are provided columnar bosses 35 which protrude from the side walls 34. The lever 32 is pivotally supported by these bosses 35. In the same manner as that shown in FIG. 3, in this male connector 31, a plurality of terminal insertion holes (not shown) are formed on a bottom wall 36. When mating terminals of the female connector 33 are inserted into the terminal insertion holes, they are contacted and electrically communicated with the terminals in the terminal insertion holes of the male connector 31.

Figure 3:
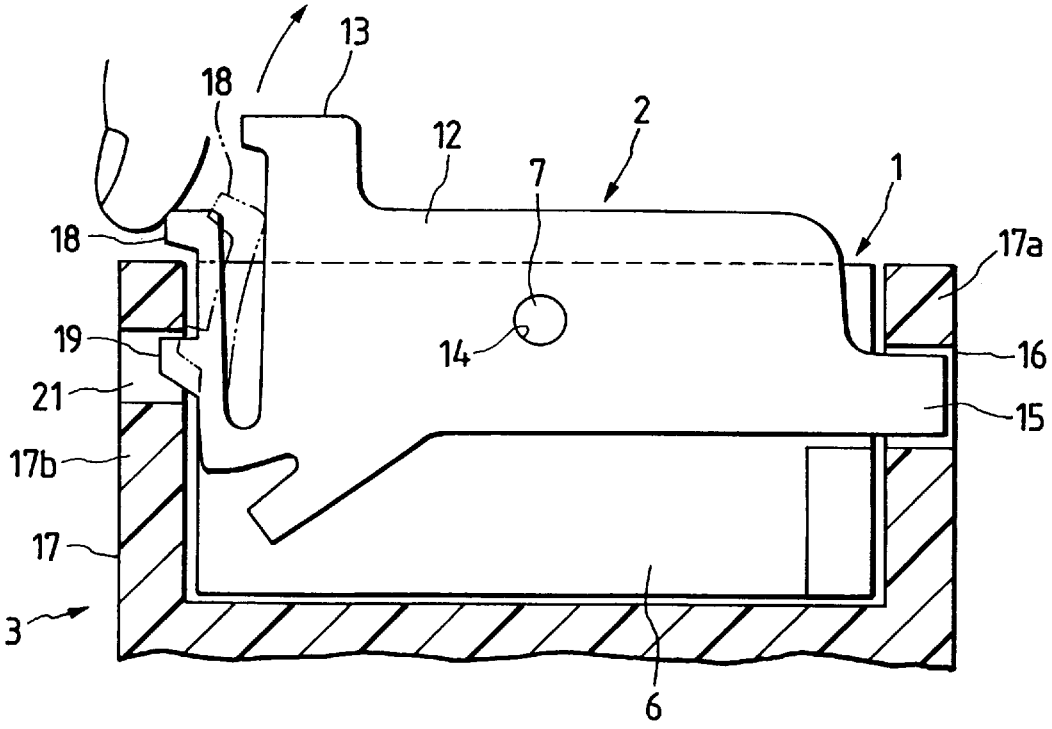
FIG. 3 PRIOR ART
FIG. 3 is a cross-sectional view of a conventional lever engagement type connector which is in an engagement condition.

In the same manner as that shown in FIG. 3, the lever 32 includes: a pair of lever walls 37 which are arranged in the transverse direction; protrusions 38 arranged at one end portions of the lever walls 37; and an operating portion 39 connected to the other end portions of the pair of lever walls 37. At the substantial center of each lever wall 37, there is formed a rotary hole 40 into which the boss 35 of the male connector 31 is inserted. The protrusion 38 of the lever 32 is inserted into an engaging hole 41 formed in the female connector 33. Due to the above arrangement, when the lever 32 is rotated, the male connector 31 can be engaged with the female connector 33. The operating portion 39 is pressed when the male connector 31 is engaged with the female connector 33. When the operating portion 39 is pressed, the lever 32 is rotated about the boss 35.

In addition to this operating portion 39, there is provided a lock arm 42 at one end of the lever 32 at which the operating portion 39 is arranged. The lock arm 42 is formed in such a manner that a lower portion of the operating portion 39 of the lever wall 37 is bent upward into a U-shape. Due to the above bent profile, the lock arm 42 is given elasticity. Accordingly, when the lock arm 42 is deformed resisting the elasticity, an elastic force is generated in the lock arm 42, and the lock arm 42 is engaged with the female connector 33 by this elastic force.

In this lock arm 42, there are provided a lock protrusion 43 and a lever 44 which are integrally formed. The lock protrusion 43 is detachably engaged with the lock hole 45 of the female connector 33. When the lock protrusion 43 is engaged with the lock hole 45, the lever 32 is attached to the female connector 33. The lever 44 is operated when the lock protrusion 43 is released from the lock hole 45.

In the upper portion of the female connector 33, there is provided a hood 46 with which the male connector 31 is engaged. In a side wall 46*a* of one side of the hood 46, there are formed a pair of engaging holes 41 with which the protrusions 38 of the pair of lever walls 37 of the lever 32 are engaged. That is, in the side wall 46*a* of the hood 46, the pair of engaging holes 41 are formed so that the pair of protrusions 38 arranged on the pair of lever walls 37 can be respectively engaged with the engaging holes 41 as shown in FIG. 2. In a side wall 46*b* opposed to the side wall 46*a* in which the engaging holes 41 are formed, there are formed lock holes 45 with which the lock arms 42 of the lever 32 are engaged. Mating terminals not shown are protruded from the bottom of the hood 46.

In each engaging hole 41 of the hood 46, there are provided an engagement fulcrum 47 and a disengagement fulcrum 48 which are separated from each other by a predetermined distance. The engagement fulcrum 47 is a fulcrum used when the male connector 31 is engaged with the hood 46, and the disengagement fulcrum 48 is a fulcrum used when the male connector 31 is disengaged from the hood 46.

In this embodiment, the engaging hole 41 is a long hole extending in the engaging direction of the male connector 31 with the hood 46. An upper end portion of the engaging hole 41 is the engagement fulcrum 47, and a lower end portion of the engaging hole 41 is the disengagement fulcrum 48. Since the engaging hole 41 is formed into a long hole, an idle running space 49, in which the protrusion 38 of the lever 32 can be moved under the condition of disengagement, is formed between the engagement fulcrum 47 and the disengagement fulcrum 48.

In this embodiment, the lever 32 is incorporated into the male connector 31 in the same manner as that shown in FIG. 3. The male connector 31 is engaged with the female connector 33 in the same manner as that shown in FIG. 3. That is, a body in which the lever 32 and the male connector 31 are assembled is inserted into the hood 46 of the female connector 33. Under the above inserting condition, the operating portion 39 is pressed, so that the lever 32 is rotated counterclockwise about the boss 35.

As shown by a solid line in FIG. 1, when the lever 32 is rotated, an upper end portion of the protrusion 38 of the lever 32 is contacted with and supported by the engagement fulcrum 47 arranged in the upper end portion of the engaging hole 41. Therefore, the lever 32 is drawn into the hood 46, and the male connector 31 is engaged with the hood 46 together with the lever 32. When the male connector 31 is engaged with the hood 46 in this way, the lock arm 42 of the lever 32 comes into contact with the side wall 46*b* of the hood 46. Accordingly, the lock protrusion 43 is elastically engaged with the lock hole 45. Due to the above engagement, the lever 32 and the male connector 31 are stably engaged with the female connector 33 without being disengaged from the hood 46.

In order to disengage and pick up the male connector 31 from the hood 46 of the female connector 33, the male connector 31 is raised while the lever 44 of the lock arm 42 is being bent by an operator's finger 50 or the like in the disengaging direction from the lock hole 45. When the male connector 31 is pulled up in this way, the lever 32 is rotated clockwise about the boss 40. In accordance with the rotation of the lever 32, the protrusion 38 separates from the engagement fulcrum 47 and moves in the direction to the disengagement fulcrum 48. At this time, the protrusion 38 moves in the idle running space 49 under the condition of disengagement until the lower end portion of the protrusion 38 comes into contact with the disengagement fulcrum 48.

When the lever 32 is rotated to a lock release position as shown by reference numeral 51 in FIG. 1, the lock protrusion 43 of the lock arm 42 is rotated by an angle so that the lock arm 42 can be disengaged from the lock hole 45 as shown by a broken line in FIG. 1. At this point of time, the lower end portion of the protrusion 38 of the lever 32 comes into contact with the disengagement fulcrum 48. Due to the above contact of the protrusion 38 with the disengagement fulcrum 48, the disengagement fulcrum 48 supports the lever 32. Therefore, the lever 32 and the male connector 31 can be picked up from the hood 46.

In this embodiment, when the male connector 31 is picked up from the female connector 33, the protrusion 38 of the lever 32 moves in the idle running space 49 of the engagement hole 41 under the condition of disengagement. Accordingly, the protrusion 38 of the lever 32 is not restricted by the disengagement fulcrum 48. Therefore, it is possible to rotate the lever 32 by a low intensity of force. Accordingly, the operator's finger 50 is not given a heavy load in the process of disengagement, and further the disengagement work becomes simple.

The lock arm 42, which is operated to disengage the male connector 31 from the female connector 33, is arranged continuously to the operating portion 39 which is operated to engage the male connector 31 with the female connector 33. Accordingly, the engagement or disengagement of the male connector 31 can be conducted at the substantially same position of the lever 32. For the above reasons, the operability of engagement or disengagement of the male connector 31 can be enhanced.

Since the engagement fulcrum 47 and the disengagement fulcrum 48 are arranged at both end portions of the engaging hole 41 formed in the hood 46 of the female connector 33, it is possible to communicate the engagement fulcrum 47 with the disengagement fulcrum 48 by a simple structure.

In addition, the protrusion 38 may have an angled portion 38*a*. The angled portion 38*a* provides additional clearance between the protrusion 38 and the disengagement fulcrum 48, which enables the lever 32 to rotate at a wider angle.

As described above, according to the invention, when the connector is disengaged from the mating connector by rotating the lever, the protrusion of the lever is moved in the idle running space under the condition of disengagement. Therefore, no force is given to the protrusion until the lock arm is disengaged. Accordingly, the connector can be easily disengaged by a low intensity of force while the operator feels no pain.

What is claimed is:

1. A lever engagement type connector in which the connector is engaged with a mating connector by rotating a lever attached to the connector, wherein the mating connector includes a hood, an engagement fulcrum which is used as a fulcrum when the connector and the mating connector are engaged with each other, and also includes a disengagement fulcrum which is used as a fulcrum when the connector and the mating connector are disengaged from each other, the engagement fulcrum and the disengagement fulcrum being separated from each other by a predetermined distance, wherein the lever includes a protrusion which moves between the engagement fulcrum and the disengagement fulcrum and engages with the respective fulcrums, the protrusion being arranged on one side of the lever, wherein the lever also includes a lock arm which is engaged with the hood of the mating connector so that the engagement condition of the connector is held, the lock arm being arranged on the other side of the lever, and wherein an idle running space related to said predetermined distance, in which the protrusion moves under the condition of disengagement when the lock arm is disengaged from the mating connector, is formed between the engagement fulcrum and the disengagement fulcrum such that, upon rotation of said lever, said lock arm is substantially moved out of the hood of the mating connector prior to the protrusion contacting said disengagement fulcrum.

2. The lever engagement type connector according to claim 1, wherein a long engaging hole into which the protrusion is inserted for engagement is formed in the mating connector in the engaging direction, and an upper end of the engaging hole is the engagement fulcrum and a lower end of the engaging hole is the disengagement fulcrum.

3. The lever engagement type connector according to claim 1, wherein an operating portion for engaging the connector with the mating connector is provided on the other side of the lever, and the lock arm is connected to the operating portion.

4. The lever engagement type connector according to claim 1, wherein the protrusion includes an angled portion for facilitating movement of said lock arm from the mating connector prior to the protrsion contacting said disengagement fulcrum.

* * * * *